US006816442B1

(12) United States Patent
Heiman et al.

(10) Patent No.: US 6,816,442 B1
(45) Date of Patent: Nov. 9, 2004

(54) INTERACTIVE SPORTS TIMER WITH AUDIO OUTPUT

(76) Inventors: Stephen M. Heiman, 212 Louis Dr., Exton, PA (US) 19341; Martin J. Dowling, 3022 Warrior Rd., Norristown, PA (US) 19401

( * ) Notice: Subject to any disclaimer, the term of this patent is extended or adjusted under 35 U.S.C. 154(b) by 0 days.

(21) Appl. No.: 09/342,280

(22) Filed: Jun. 29, 1999

(51) Int. Cl.[7] ..... G04F 10/00; G08B 1/08

(52) U.S. Cl. ..... 368/107; 368/3; 368/9; 368/109; 368/113; 340/309.16

(58) Field of Search ..... 368/1, 3, 9, 12, 368/107–109, 113, 274, 11, 110–112, 119, 309.15; 340/323 R, 309.16, 825.69, 326, 286.01

(56) References Cited

U.S. PATENT DOCUMENTS 3,651,507 A * 3/1972 Abbott ..... 340/323 R
4,045,788 A * 8/1977 Castelli et al. ..... 340/323 R
4,263,736 A * 4/1981 Beierwaltes et al. .... 340/323 R
4,316,273 A * 2/1982 Jetter ..... 368/109
4,505,595 A * 3/1985 Rose et al. ..... 368/113
4,535,333 A * 8/1985 Swardowski ..... 340/5.25
4,637,732 A * 1/1987 Jones et al. ..... 368/109
4,901,294 A * 2/1990 Aihara ..... 368/113
5,027,102 A * 6/1991 Sweeny ..... 340/323 R
5,084,695 A * 1/1992 Freeman ..... 340/323 R
5,195,064 A * 3/1993 Hegarty et al. ..... 368/274
5,293,354 A * 3/1994 Costabile ..... 368/11
5,574,422 A * 11/1996 Martin ..... 340/323 R
5,646,911 A * 7/1997 Davis ..... 368/10
5,706,258 A * 1/1998 Poe et al. ..... 368/274
5,898,587 A * 4/1999 Bell et al. ..... 340/323 R
6,012,995 A * 1/2000 Martin ..... 340/323
6,052,054 A * 4/2000 Hampson et al. ..... 340/323 R
6,072,384 A * 6/2000 Baker ..... 368/108
6,144,620 A * 11/2000 dePoortere ..... 368/108
6,181,236 B1 * 1/2001 Schneider, Jr. ..... 340/326
6,270,431 B1 * 8/2001 Martin ..... 340/323 R
6,369,697 B1 * 4/2002 Poole ..... 368/11
6,603,711 B2 * 8/2003 Calace ..... 368/109

OTHER PUBLICATIONS

Echicho, Naoyuki, Voice Inputting/Outputting Watch, JP 357063467, abstract, Apr. 1982.*

Inoue, Tsutomu, Time Measuring Instrument, JP 363098586, abstract, Apr. 1988.*

Hagimoto, Nobuo, Vocal Announcing Device of Time, JP 404140689, abstract, May 1992.*

* cited by examiner

*Primary Examiner*—David Martin
*Assistant Examiner*—Jeanne-Marguerite Goodwin

(57) ABSTRACT

A sports annunciation system is remotely controlled by players in unofficiated games. Players start and stop game timers by wireless communication to a base unit using a switching device on their person. The system audibly announces time-in, time-out, remaining time and key game events. The device simulates time control and announcements found in officiated games.

5 Claims, 7 Drawing Sheets

INTERACTIVE SPORTS TIMER WITH AUDIO OUTPUT

FIELD OF THE INVENTION

The invention generally pertains to timing amateur sports games, and more particularly to providing interactive audio announcements of timing information.

BACKGROUND OF THE INVENTION

While the invention can be used with many games, basketball will often be used as a concrete example.

Pickup games in sports, while fun, lack the sparkle of professional and collegiate games. Two learns keep track of score as in paid attendance games, but the atmosphere and intensity are not the same. There are two elements lacking in informal games that explain the missing luster: timing and realistic sounds.

Time plays an important role in many sports such as basketball, football and hockey. In these games it is not sufficient to accumulate more points than your opponent, but to do so within a specified time period. In close games there is a mad rush to score the winning points before time runs out. Time-outs are called to plan strategy and set up plays. In basketball a shot clock forces the teams to try to score within a short time interval. This element of time, so exciting in professional and collegiate sports, is absent in pick-up games played in streets, driveways, and vacant lots. These games are decided by points with no regard to time. However, timing is important. There is nothing like a time limit to force bold and exciting play.

One of the reasons one never sees timing in pickup games is because a time display large enough to be seen at, say, half-court, would be expensive, large, heavy, and power consuming. A large display would also be delicate unless extremely expensive, and would degrade or break when subjected to the inevitable impacts of a basketball. Furthermore it would lack the easy portability required of any apparatus that could be used in informal games. For pickup games, it would be too inconvenient to carry anything large or heavy.

The other factor that adds to the excitement are the sounds of a game—voice announcements of time-outs and time remaining; crowd noise; musical flourishes; a horn to signify the end of shot clock time or the end of regulation play; cheering in the last seconds of the game. The sounds of a game are usually related to time events in paid attendance games.

One never hears professional-sounding announcements or horns in pickup games because such sounds would only make sense if they were related to the pace of the game. A gadget that generates specified sounds when designated buttons are pushed would be more of a nuisance than useful because someone, either a player or an observer, would have to push a button each time a certain sound were desired. Such a routine would, quickly prove laborious. Sounds, to be desirable, must be synchronized to the action of the game.

To be accepted, any system that brought new elements into pickup games would have to be very little trouble. Not only would it have to be lightweight, rugged, small, and economical to manufacture, but would also have to be user-friendly. By this is meant it couldn't require players to be constantly running over to a fixed set of buttons to call time-out or start a shot clock, for example. It must combine the features of timeliness and germane sounds with great ease of use.

It is the purpose of this invention to bring the excitement of time and sound into informal games—without requiring the help of bystanders or placing a burden on the players.

Prior Art

It is universally assumed that the best, fairest, and only way to indicate time remaining and other sports timing information in a manner that can be communicated to all players in a game simultaneously is via a large display. Scoreboards, such as described in U.S. Pat. No. 4,045,788 to Castelli et al (1977), often include "indicating", i.e., displaying timers as an adjunct to the main score display. However, large scoreboard/clocks and large clocks are impractical for informal games. Even personal. timers, like stop watches, rely on visual output. U.S. Pat. No. 5,663,897 to Geiser (1997) provides a hand worn apparatus for swimmers that permits time keeping and stoke counting, and provides feedback to the wearer by numeric and graphic indicators. Personal timekeepers require a player to look away from the game, and do not provide key timing information to other players.

Some prior art exploits buzzing sounds and vibration. U.S. Pat. No. 4,998,727 to Person (1991) teaches a foot-activated training timer that activates a buzzer. It assumes the person conducting the timing is stationary. U.S. Pat. No. 4,637,732 to Jones et al (1987) teaches a sports timing device for referees, officials, and the like that is activated by depressing a primary switch and indicates expiration of time by providing a tactile vibration. This is useful only for short time durations and only alerts the person who carries the device.

U.S. Pat. No. 4,879,699 to Sakamoto (1989) teaches a timepiece with audio output, used to indicate time of day or sound an alarm. U.S. Pat. No. 3,998,045 to Lester (1976) describes a watch timepiece with voice output, also for the purpose of announcing the time of day. Neither allows time-outs nor remaining time announcements. These inventions were designed to communicate standard clock time, not for interactive sports timing and broadcast announcements.

Another timing device is the "Talking Timer 810038" made by Sper Scientific, LTD of Scottsdale, Ariz. It performs standard timer functions such as counting down, with the additional attribute of audible announcements. This timer and others like it are not suitable for sports because the announcements are not game related and they do not provide a control means for teams to remotely start and stop the timer while playing ball.

It can be seen that prior art timing devices for sports are either large, costly displays or personal devices that alert a single player about a specific timing event. General purpose time pieces are designed to communicate standard clock time and are incompatible with sports timing requirements. General purpose timers do not generate sports-related sounds nor easy interactive control.

SUMMARY OF THE INVENTION

To avoid the limitations and problems with present devices, the objects of the invention are to convey key timing information to all players simultaneously by voice announcements and to enable the players to remotely control the start and finish of time-outs and short time intervals such as shot clock time.

By switching sports timing from graphical displays to interactive voice announcements, the present invention produces two substantial and unexpected results. First, the cost drops dramatically as one goes from large expensive displays to a sound system. This makes the sports timing system affordable for amateur players having fun in pickup games. Second, it precludes the need for players to turn their attention from the game to the display when they want to know how much game or shot clock time remain. At frequent intervals they will hear the time remaining and all players will receive the information simultaneously so that a person whose view is blocked will not have a disadvantage.

The present invention obtains the desired sense of timing in informal basketball games by providing a processor to keep track of time remaining, time-outs, shot clock time, and other timing functions; by providing software generated sounds, simulated or pre-recorded, that make voice announcements, crowd noises, horn blares and other acoustic signals, and do so at appropriate moments based on time considerations; and by providing remote control means that enable players to easily call time-outs, start the shot clock and control and activate other timing functions while playing the game.

The present invention significantly improves upon prior art by not only bringing sports timing information and excitement to players in a new and better way, but also bringing the cost of sports timing down to affordable levels for informal games.

DESCRIPTION OF THE PREFERRED EMBODIMENT

Figure 1:
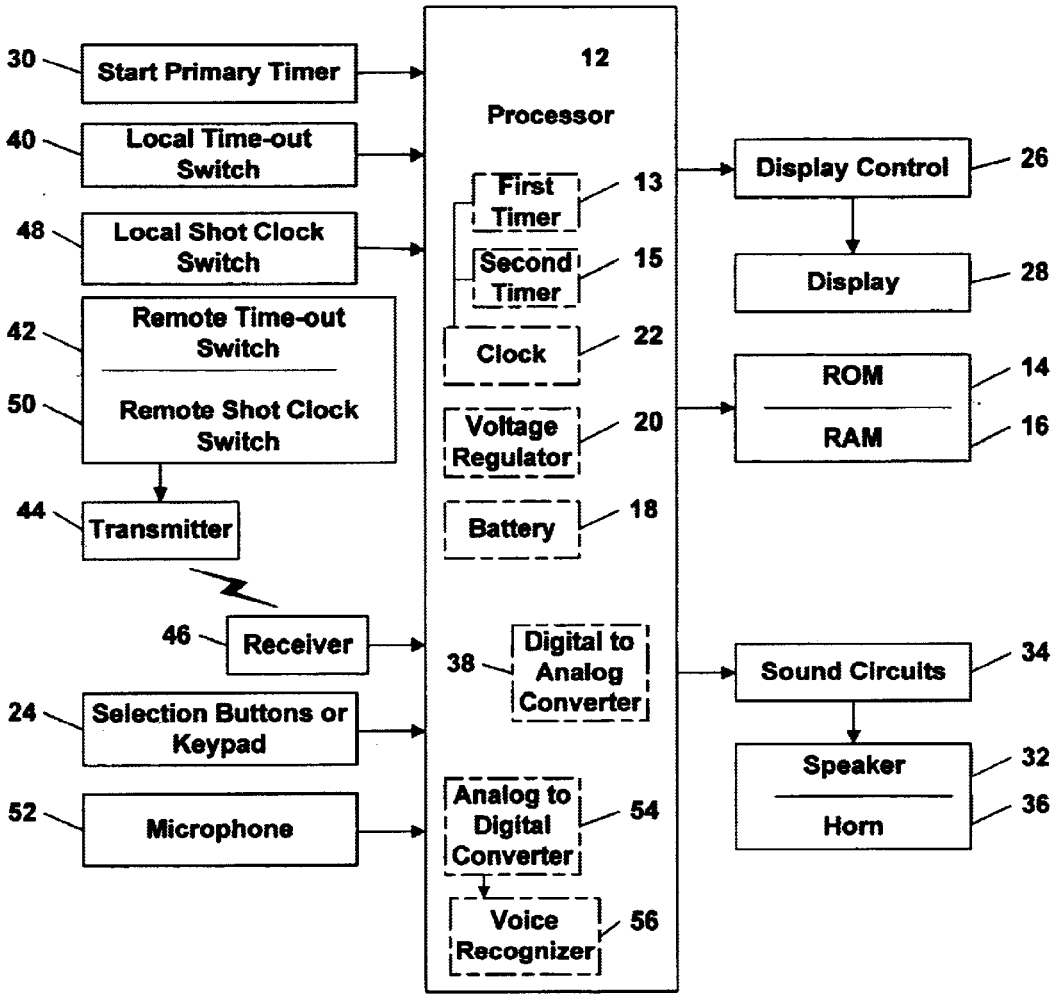
FIG. 1 is a block diagram of a preferred embodiment of the interactive sports timer with audio announcements.

The invention provides both interactive and preprogrammed timing for sports games, and for voice and other announcements when specified times occur. While the invention can be used with many games, such as football and street hockey, basketball will often be used as a concrete example Referring to the drawings, wherein the same reference numerals indicate like elements throughout the several figures, there is shown in FIG. 1 a functional schematic block diagram of a preferred embodiment of a processor-based timer-speaker system 10 which operates in accordance with the methods of the present invention. In the presently preferred embodiment, system 10 includes a controller or processor 12 which controls the timing, visual and audio outputs, and other functions.

Preferably processor 12 includes or has access to a read only memory (ROM) 14 for storing fixed information such as executable processor code, fixed or default timing parameters or parameter ranges, files containing digital representation of prerecorded voice announcements, and/or files containing fragments of announcements that are concatenated to produce a complete voice announcement. ROM 14 is of a type well known to those skilled in the art for storing fixed information that is not changed by the processor during execution of processor operations. ROM 14 may utilize magnetic, optical, or other media and may be of the type that can be reprogrammed, such as EPROM, to allow easy modification of the program as the need arises.

Processor 12 also includes or has access to random access memory (RAM) 16 for temporary storage of data such as saved time values, and temporary storage of executable code and digitized voice announcements. RAM 16 is of a type well known to those skilled in the art, and may utilize magnetic, optical or other media, and may be associated with any format such as PCMCIA compatible storage devices.

ROM14 is a storage device for storing a plurality of audio files and a set of predetermined times. RAM 16 also serves this purpose on a temporary basis.

Processor 12 is preferably powered by batteries 18. The batteries provide portability, which allows the system to be easily carried to game areas. This does not preclude use of other power sources such as operation out of a car battery or from connections to the alternating current power grid. A voltage regulator 20 is included as needed.

Processor 12 also includes or has access to a clock 22 which provides a time baseline. It is not necessary that the clock be synchronized to standard time zones, only that it correctly tracks the passage of time. Clock 22, in conjunction with processor 12, serves as a timer to keep track of game time.

A keypad or set of buttons 24 is employed as a user input device to enter initial settings into processor 12. Before starting a game, the players use keypad 24 to set up timing parameters or accept default settings. The parameters may include, for example, (a) length of game; (b) duration of time-outs; (c) shot clock duration; (d) option for crowd noise toward end of game; (e) the particular voice used for announcements.

The preferred embodiment includes a display control 26 and display 28 to prompt the user during setup, provide visual feedback to the user as he enters setup information, and provide a game clock readout. Display 28 need not be large and expensive since the user will be standing close to it during the pre-game setup. During the game the primary time indication will be by voice announcements, and the display serves an auxiliary role. Preferably display 28 uses LCDs, but any other display technology is acceptable.

A switch 30 is provided to start primary, or first, game timer 13. This may operate independently or in conjunction with other switches to be described. Switch 30 is connected to processor 12 in such a manner that the processor starts timing the game when the switch is closed.

Timer-speaker system 10 broadcasts audible voice announcements using a speaker 32. The digital files stored in ROM 14 or temporarily in RAM 16 are converted to analog signals in digital-to-analog converter 38. These signals are then processed via circuits 34 which may contain an integrated circuit and amplifier. In an alternate embodiment, digital to analog converter 38 is contained in sound circuits 34 rather than processor 12. In the preferred embodiment the recognizable voice of a professional, well-known announcer is used for the announcements. While this is preferred, any voice can be used. Preferably the full announcements are stored in digital files in ROM 14, but alternately, they can be stored temporarily in RAM 16, or individual words can be stored and concatenated upon playback. Alternately, a voice record/playback single-chip can be used that contains sufficient ROM and RAM for voice storage and handling purposes, digital to analog converter 38 and filtering and amplification 34.

When switch 30 is closed, processor 12 causes speaker 32 via digital to analog converter 38 and sound circuits 34 to announce game time. For example, if the game time has been set for 20 minutes, speaker 32 announces "Starting game at 20 minutes," or "Twenty minutes remaining," or "20 minutes," or similar voice announcement that indicates the time remaining. To enhance realistic effects a horn 36 may be added to the system to reproduce the end-of-game sound. Preferably, a digital file of a horn sound can be stored in ROM 14 or temporarily in RAM 16 and outputted to speaker 32 to simulate the horn sound without actually using horn 36. A horn sound is desired in order to simulate the end sound of an official game. The preferred embodiment also provides musical flourishes and crowd noises toward the end of the game. These are reproduced from digital files stored in ROM 14.

Speaker 32 is the preferred electro-acoustics device to announce timing events to players.

As the game progresses and time remaining decreases, at certain specified intervals the processor causes the speaker to announce the remaining time. An example of such announcements at predetermined times is illustrated in the following table:

TABLE 1

Announcements Caused by the Primary Timer

| Seconds on Primary Timer | Audio Out |
|---|---|
| 1200 | 20 Minutes |
| 900 | 15 Minutes |
| 600 | 10 Minutes |
| 300 | 5 Minutes |
| 240 | 4 Minutes |
| 180 | 3 Minutes |
| 120 | 2 Minutes |
| 90 | 1 Minutes 30 Seconds |
| 60 | 1 Minute to go! |
| 30 | 30 Seconds |
| 20 | 20 Seconds |
| 10 | 10 Seconds |
| 9 | 9 |
| 8 | 8 |
| 7 | 7 |
| 6 | 6 |
| 5 | 5 |
| 4 | 4 |
| 3 | 3 |
| 2 | 2 |
| 1 | 1 |
| 0 | HORN |

When switch 30 is initially closed, processor 12 also causes display 28 in conjunction with display control 26 to show the preset game time. As time passes, the processor causes the display to show time remaining at one second intervals until the last seconds of the game at which time the display shows the passage of time in increments of tenths of seconds. This is the preferred embodiment, but announcements and display can be updated at any appropriate time intervals.

In the preferred embodiment a remote time-out switch 42 is worn by,key players to enable them to call (i.e. initiate) a time out. Switch 42 and its accoutrements may have the appearace of a wristwatch with a large button When a player presses the button a transmitter 44 enclosed with the switch sends a wireless signal that indicates the time-out switch has been closed. The wireless signal may be electromagnetic such as radio frequency waves used in walkie-talkies, optical infrared such as used in TV remotes, ultrasonic, sonic such as by audible tones, or any other manner by which a signal may be transmitted reliably without the use of wires, cables or fibers. The transmission is detected by receiver 46 that decodes the signal and sends a hardwire or fiber signal to processor 12 indicating that time-out has been called.

Switch 42, in conjunction with transmitter 44 and receiver 46, is the preferred remote control means for players to start and stop timer 13 by wireless communication.

The duration of the time-out will have been preset via keypad or buttons 24, or a default will have been selected. When the break in action has expired, processor 12 indicates this to the players by speaker 32 and or display 28 that it is time to restart the game. Preferably when the break is over the processor causes speaker 32 to carry a voice announcement of "Start the Clock," "Time in" or other announcement indicating that the break in action is over. When the players are ready, one of the players activates time-in switch 42 to cause the game time to start again at the same time it stopped when time-out was activated. In the implementation in FIG. 1, switch 42 toggles and serves as both time-out and time-in switch. As is well known to practitioners in the art, the functions of time-in and time-out could just as easily be divided among two switches. Preferably during the break, display 28 will continue showing the (fixed) time remaining when time-out was called. When the break is over, the processor starts again to update the announcement times and visual display in accordance with the predetermined schedule.

An alternate embodiment starts updating the timer and display automatically when the predetermined time-out period is ended, rather than wait for a player to activate the timer.

An auxiliary local time-out switch 40 can be provided to allow a coach or cooperating spectator to control the timer. The primary time-out switch is remote switch 42.

An example of the voice announcements that may occur when time-out is called and when it ends is illustrated in the following table:

TABLE 2

Announcements Associated with Time-Outs

| | |
|---|---|
| Interrupt | Audio Out |
| Interrupt | Time Out! |
| Reset | Start the Clock |

The preferred embodiment includes both remote and local time out switches 42 and 40. Either may be used to activate the time-out state. It is to be understood that the above discussion is for the configuration in which time-out switches 40 and 42 toggle and thus serve also as time-in. As mentioned previously, the time-in switch (not shown) can be eliminated if desired in which case the timer and display continue where they were when time-out was called. The advantage of using a time-in switch, whether included in switch 42 or separate, is to allow players extra time to resume their playing positions after "Time-in" is announced.

In the preferred embodiment a secondary timing function is also provided by processor 12. The purpose of second timer 15 is to provide timing of short duration events such as a time limit on holding the ball without shooting, otherwise known as the shot clock, or a twenty five second limit for snapping or free kicking after "ready for play" in football A remotely controlled secondary timer switch 50 is provided to be activated by a player, that activates the shot clock or secondary timer IS. This secondary timer switch 50 does not interfere with the game time clock 13, which keeps running. In the preferred embodiment, a local (non-wireless) secondary timer switch 48 is also provided to enable a coach or cooperating spectator the ability to start the secondary timer.

In the preferred embodiment one or more players are provided with remote secondary timer switches 50 that they can activate easily by pressing a button on their person. Preferably switch 50 and associated circuitry are enclosed in the same housing as time-out switch 42 and its associated circuitry. Secondary timer switch 50 need not be activated routinely but it is available in case one team holds the ball for a long time without making a serious effort to score, at which point the defending team can start timer 15 thereby forcing the offensive team to shoot within a reasonable time period. Remote switch 50 is connected to transmitter 44, which may be the same or different one as used with remote time-out switch 42. Receiver 46 can be the same or different one as the receiver used with remote time-out switch 42. In either case the signals must be sufficiently different for time-out and shot clock so that the receiver or receivers interpret the signal unambiguously.

It is preferred that both local 48 and remote 50 shot clock switches be available. Preferably one key player on both teams carries a remote switch unit comprising switches 42 and 50 as well as transmitter 44.

An example of announcements that may be used to indicate seconds remaining on the shot clock are illustrated in the table below:

TABLE 3

Announcements Based on Secondary Timer

| Seconds on Secondary Timer | Threshold | Audio Out |
|---|---|---|
| 25 | 25 | 25 on the shot clock |
| 10 | 10 | 10 on the shot clock |
| 5 | 5 | 5 on the shot clock |
| 4 | 4 | 4 |
| 3 | 3 | 3 |
| 2 | 2 | 2 |
| 1 | 1 | 1 |
| 0 | 0 | HORN |

The timer-speaker system also includes an off-on power switch (not shown).

In summary, processor 12 starts and stops the game and secondary timers 13 and 15 respectively when previously described remote control means are activated; selects appropriate audio files, such as illustrated in text form in the enclosed tables, at predetermined times; and passes these audio files to electro-acoustics devices such as speaker 32 and horn 36, in conjunction with digital to analog converter 38 and sound circuits 34 to be used as required or convenient, thereby generating audible sounds such as shown in text form in the enclosed tables.

Figure 2:
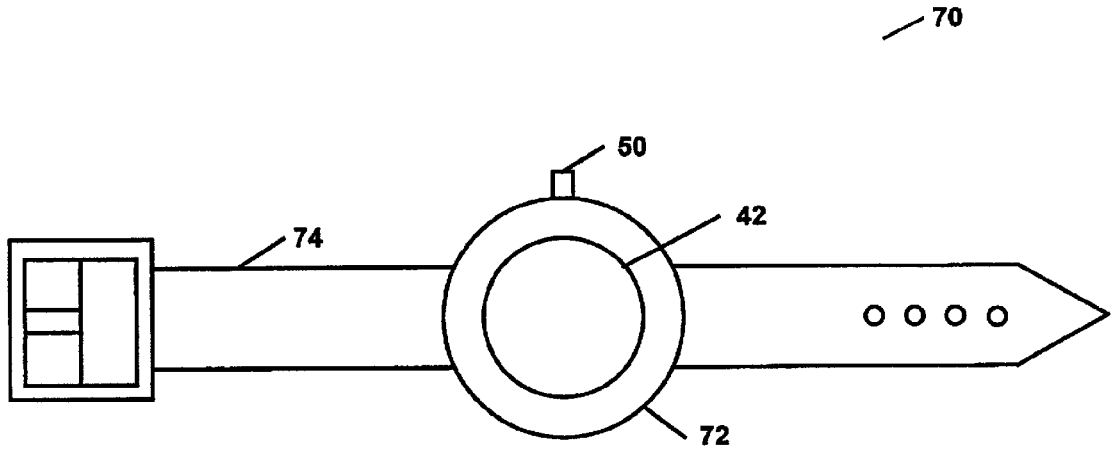
FIG. 2 shows a configuration of a remote control worn by players on their wrist.

FIG. 2 shows the preferred embodiment of a remote switch and transmitter unit 70 to be worn by designated players. A large button 42 serves as the time-out switch which, when closed, causes transmitter 44 (not shown) inside a case 72 to send a time-out signal to receiver 46 (not shown). A smaller switch button 50 causes transmitter 44 (not shown) inside the case to send a start shot clock signal to receiver 46 (not shown). The preferred attachment to the player is by a strap 74 as used in wristwatches. Other attachments such as by clips and pins and Velcro® are also suitable.

Figure 3:
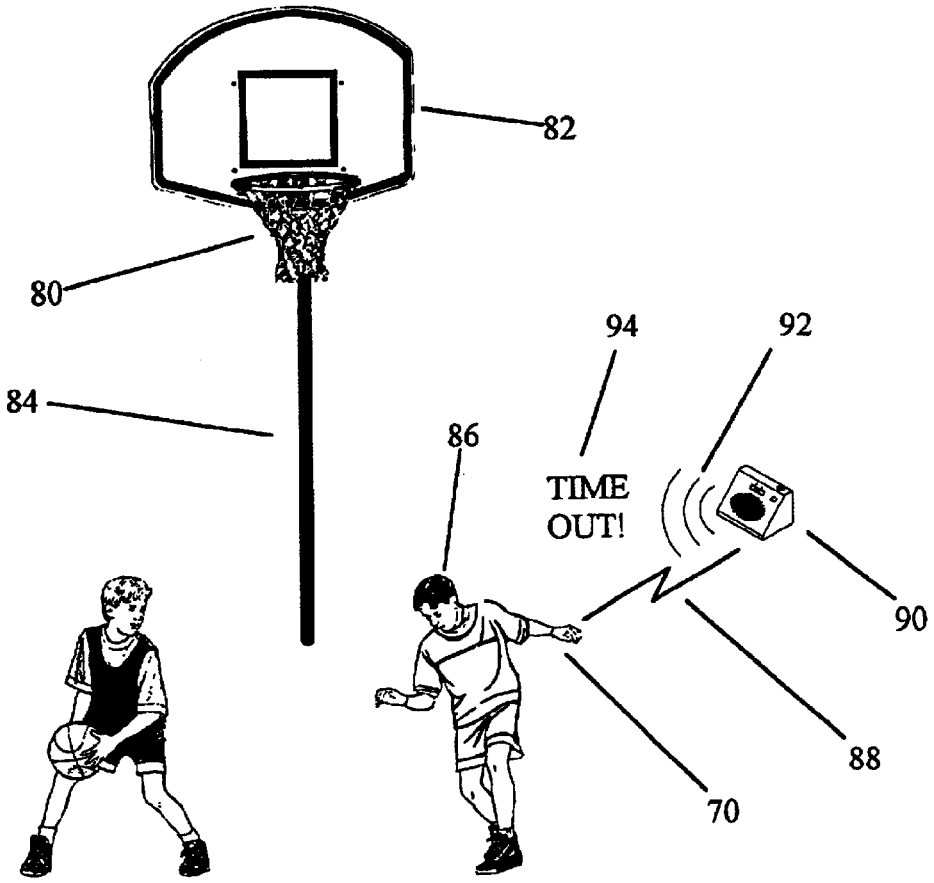
FIG. 3 illustrates the use of the sports timer in a basketball game.

FIG. 3 illustrates the use of the sports timer-speaker in a basketball game. For simplicity only two players are shown, but typically there would be four or more players. The number of players is not important for the purposes of this invention. A standard outdoor basketball goal is shown consisting of a hoop and net 80, backboard 82 and post 84. A player 86 wears the wrist strap embodiment of remote switch and transmitter unit 70 shown in FIG. 2. Upon activation of wrist switch 42 the transmitter inside case 72 emits a wireless signal 88 using any of the technologies previously described such as ultrasonics, infrared, acoustic or radio frequency waves. In FIG. 3, wireless signal 88 transmits through the air to the timer-speaker base unit 90. Receiver 46 (not shown) embedded in or connected to base unit 90 relays the change in switch state to processor 12 (not shown) which is housed inside the base unit. In FIG. 1, processor 12 addresses the appropriate file or files in memory 14 or 16, concatenates the files as necessary to form a new file containing the complete phrase, and sends the resulting digital audio file to digital-to-analog converter 38. Converter 38 outputs an analog form of the audio file to sound circuits 34 which appropriately condition the analog sound for speaker 32. The analog signal is then output to the speaker or other electro-acoustic converter. Referring again to FIG. 3, the speaker inside base unit 90 causes acoustic waves 92 to be propagated thereby causing an audible announcement 94 such as "Time Out!" While the process is complicated, with modern processors the speed at which the announcement takes place is extremely fast, and will be perceived as instantaneous by the players.

Figure 4:
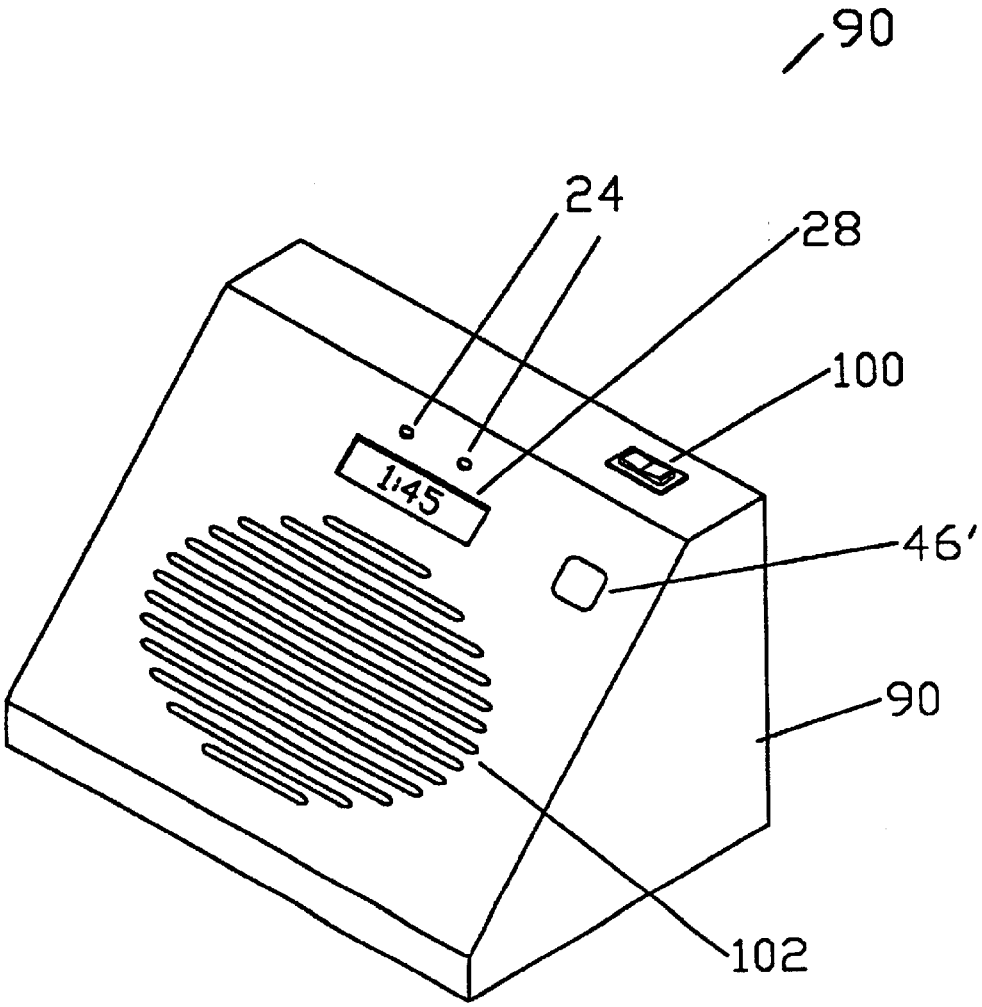
FIG. 4 illustrates an embodiment of the timer-speaker base unit.

FIG. 4 shows an embodiment of announcement-timer base unit 90. Shown is a speaker grille 102 which protects speaker 32 (not shown). There is an off-on switch 100 and visual display 28. Display 28 doubles as a remaining-time indicator during play action and as a feedback indicator during setup. Setup buttons 24 are shown. Local switches 40 and 48 and microphone 52 may or may not be used and are not shown. The receiver sensor is shown as 46' for the particular case of infrared or optical transmission. (The receiver sensor 46' is part of the receiver 46, not shown)

Figure 5:
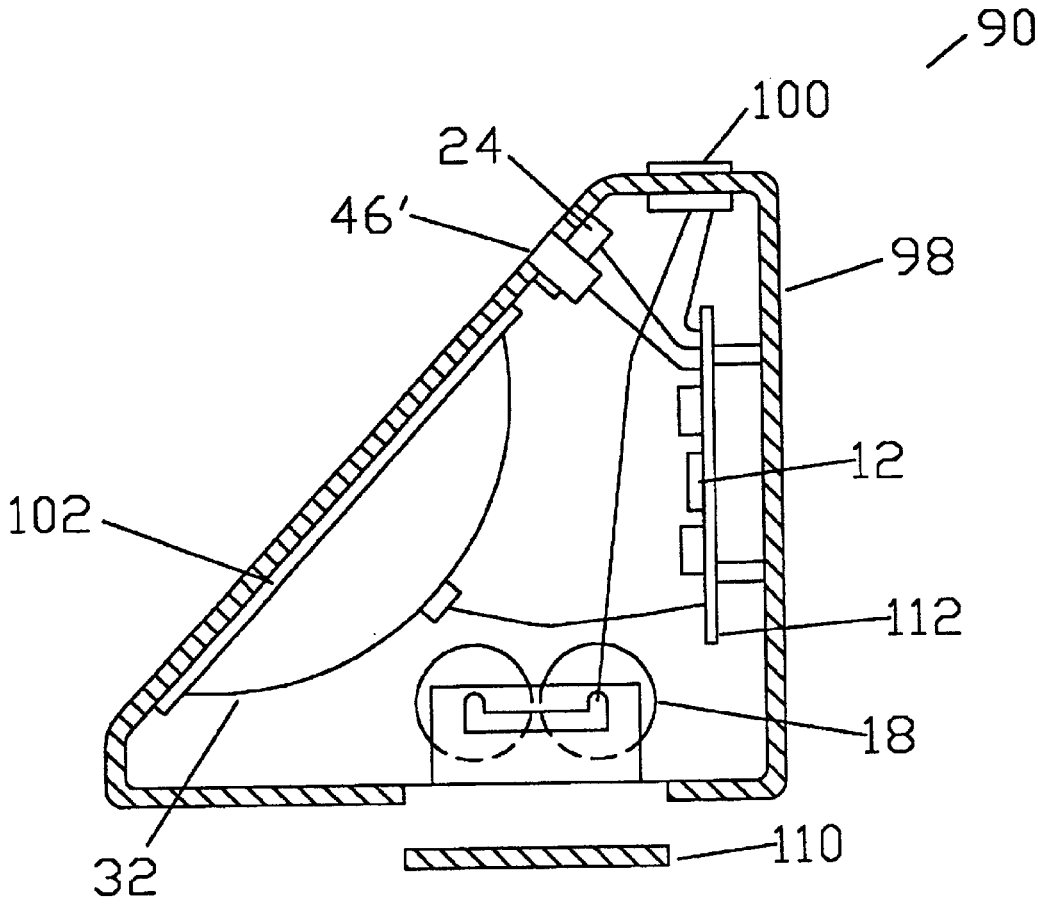
FIG. 5 shows a side sectional view of the timer-speaker base unit.

FIG. 5 shows a side sectional view of timer-speaker base unit 90. Speaker 32 and or horn 36 (not shown) are protected by grille 102. Batteries 18, and a printed circuit board 112 are enclosed in a high impact plastic case 98. A removable battery cover 110 is shown. In one implementation the circuit board 112 contains processor 12, RAM 16, ROM 14, clock 22, voltage regulator 20, receiver circuits 46, display and sound circuits 26 and 34, respectively, and others not shown. On the face of case 98 are mounted an off-on switch 100, an optional time-out start switch 40 (not shown), and shot clock switch 48 (not shown). Preferably the case also contains set up buttons 24, and time remaining display 28 (not shown). If infrared technology is used to transmit signals from the remote switches worn by the players, then an infrared detector window would also be placed on the case face. Infrared sensor 46' is shown.

Figure 6:
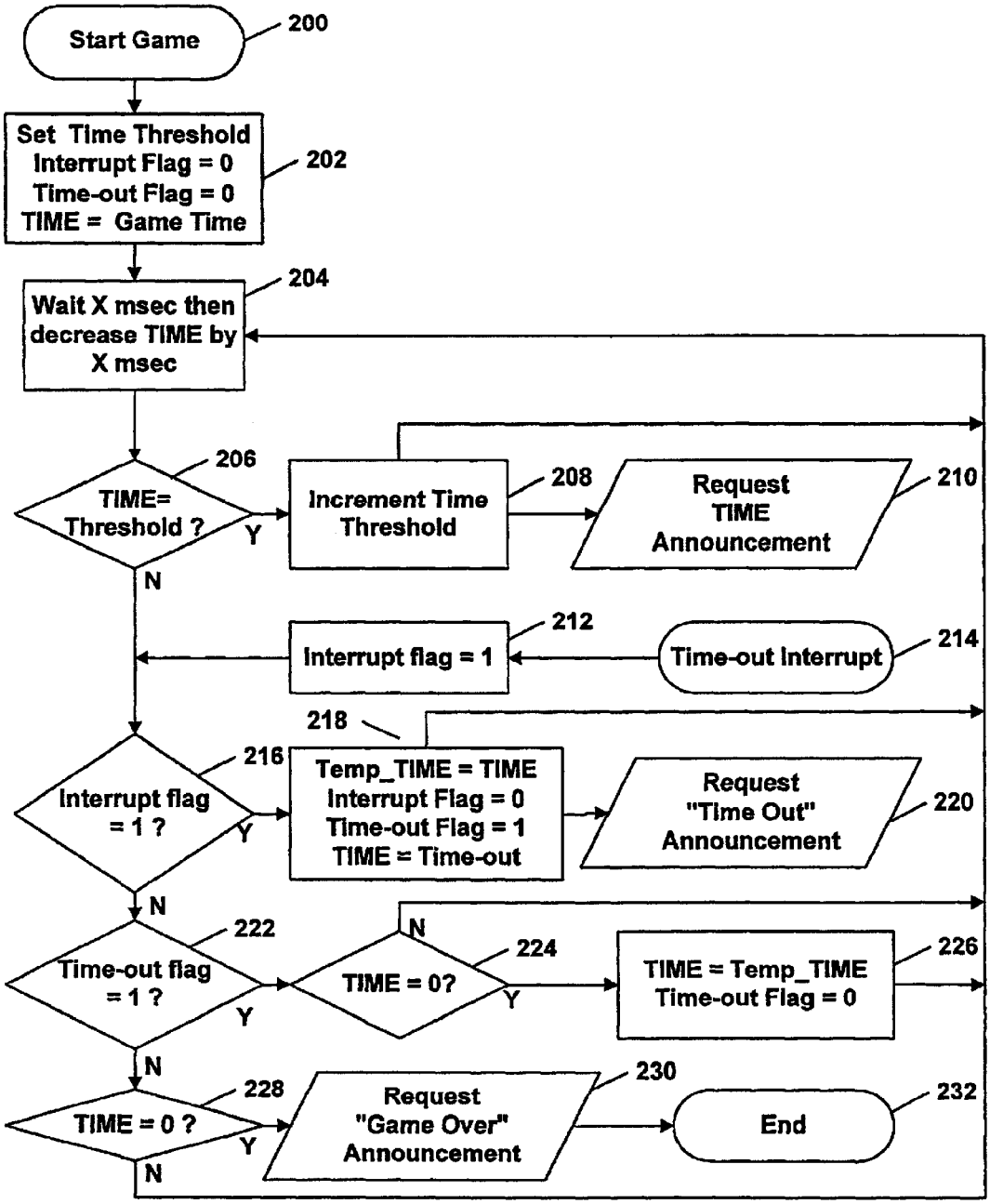
FIG. 6 is a flow chart of the primary timer, indicating the timing-announcement logic for game time remaining and time-outs.

FIG. 6 illustrates the primary timer flow chart. It shows how timer 13 keeps track of game time, starts and stops when remote control means are activated, and selects and passes on audio files when key timing events occur. Many timing schemes are available but the one presented is a preferred implementation. The program starts at step 200 when Start Game (Primary Timer) switch 30 is actuated. This causes the first time threshold to be set at step 202. The thresholds are taken from Table 1. If the game is set up for 15 minutes, for example, the first threshold is the next lower value, or 600 seconds. (This is the next lower time below 15 minutes or 900 seconds in Table 1). At the start of the game, the Interrupt Flag and Time-out Flags are set to zero and the variable TIME is set to game time, which is 900 seconds in this example.

In step 204, a timing loop decrements in units preferably less than a tenth of a second. The time decrement is shown as X msec (milliseconds) in FIG. 6, where X can be any reasonable value such as 10 msec or 50 msec for example. For illustration, let X be 10 msec. As it enters the loop, TIME=900 seconds. The first time through the loop the TIME is decremented by 10 msec and becomes 899.990 seconds. A decision node 206 checks if TIME equals the current threshold, 600 seconds. Since it does not, the flow proceeds directly down to the next decision node 216. If TIME had equaled the current threshold, the threshold would change in step 208 to the next lower threshold and the program would request a time announcement step 210.

Occasionally a player will request a time-out by activating his time-out switch 42 causing a timeout signal to be sent from transmitter 44 to receiver 46. This causes a time-out interrupt 214 to occur in the software process. When a time-out is received, the interrupt flag is set to unity in step 212.

The software checks in every loop cycle for the state of the interrupt flag. Normally it will be set to zero and the software will proceed to the next decision node 222. However, when time-out interrupt flag is set to unity (Yes branch in node 216), several events occur in step 218. The TIME value is stored in a temporary location, Temp_ME, and TIME is reset to the preset time-out duration, say 25 seconds. Since the Interrupt Flag has been acknowledged it is reset to zero. This re-arms it for the next timeout. Since we are now in time-out, the Time-out Flag is set to 1 and remains there until the timeout has ended. A request is sent to cause a "Time Out!" announcement step 220 in accordance with Table 2. The logic then loops back to step 204 where, 10 msec later, TIME is decremented by 10 msec. and the process is repeated. The next time through the loop the interrupt flag will be zero and the logic will proceed to decision node 222.

Decision node 222 determines if the system is in normal or time-out mode. If the time-out flag=1 (Yes branch in node 222) then the value of TIME is checked in node 224 to determine if it is zero. Typically during timeout it will not be (No branch in node 224) and the logic will proceed back to step 204 for the next cycle 10 msec later. When the end of time-out is reached, node 224 will register yes. Time is returned to normal time in step 226 by setting TIME equal to the stored Temp_TIME. The Time-out flag is returned to its normal state (zero) and the logic proceeds to step 204 where the cycle starts over 10 msec later.

In the usual process there is no time out and the flow proceeds directly from step 204 and node 206 to decision node 228 which in essence is asking if the game is over. Normally it will not be over (No branch in node 228) and the logic proceeds to step 204 where the next cycle starts 10 msec later. There is one moment in every game, however, when TIME=0. This signifies the game is over. A request in step 230 is then generated for a "Game Over" Announcement or for a horn actuation. The program ends at terminus 232.

Figure 7:
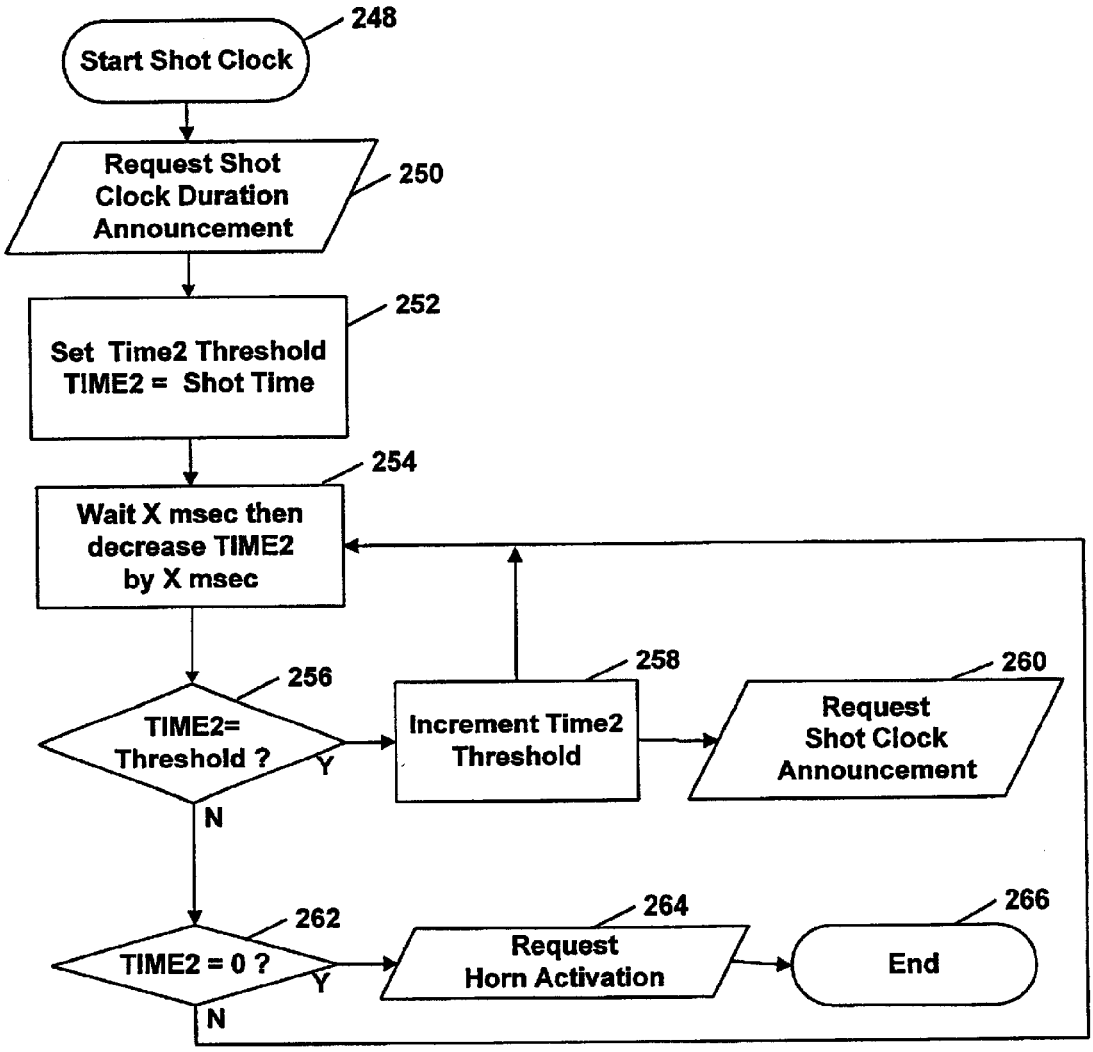
FIG. 7 is a flow chart of the secondary timer, illustrating the timing-announcement logic for a shot clock in basketball.

FIG. 7 illustrates the secondary timer flow, using the shot clock in basketball as an example. This details a second timer which keeps track of time for a predetermined short time interval within the game, and generates additional appropriate voice announcements. A player or spectator starts the shot clock by activating local shot clock switch 48, or, preferably, a player starts it by using remote switch 50. This starts a shot clock in step 248, causing the preset shot clock time to be announced in step 250 so the players are made aware that the shot clock has been started and how much time is allowed. Next, the first "Time2 Threshold" is set at step 252. The thresholds are taken from Table 3. If the shot clock is set for 25 seconds, for example, the first threshold is the next lower value, or 10 seconds. (This is the next lower time below 25 seconds in Table 3). When the shot clock is started, TIME2 is set to shot clock time (25 seconds in this example) at step 252.

In step 254 a timing loop decrements in units preferably less than a tenth of a second. This is shown as X msec in FIG. 7, where for illustration we let X=10 msec (milliseconds). As it enters the loop, TIME2=25 seconds. The first time through the loop TIME2 is decremented by 10 msec and becomes 24.990 seconds. A decision node 256 checks if TIME2 equals the current threshold, 10.000 seconds. Most of the time, TIME2 does not equal a threshold, but when it does, Time2 Threshold is incremented in step 258 to the next lower value in the left column in Table 3 (this is an increment in an address, but a decrement in terms of time remaining), and a request in step 260 is generated to announce shot clock time, which is the current threshold time.

In the usual case TIME2 does not equal a threshold at node 256 and the logic proceeds to decision node 262. There it is determined if TIME2=0, that is, if the shot clock time has expired. If it has not expired the logic proceeds to step 254 where, after 0.010 seconds (10 milliseconds), TIME2 is decremented by 0.01 seconds and the cycle repeats. When finally TIME2 has decreased to zero (Yes branch in node 262) a request is made for Horn activation in step 264 and the program ends at terminus 266.

When requests are made by the primary or secondary timer to activate an announcement or a horn, the activation does not automatically take place for various reasons. Conflicts will sometimes occur between the two timers (game time and shot clock in the example) as they both try to activate announcements simultaneously or sufficiently close that they will cause confusion. There may also be times when the game has ended but the shot clock is still running and requests announcements after the game is over. Thus part of the functionality of the processor is to resolve such conflicts. It does this by the following rules:

1. The shot clock timer may make no announcements or horn activations in the last ten seconds of the game and after the game has ended.
2. Other than the last 10 seconds of game time, the timer with the least time remaining has priority.

These rules are preferred but reasonable alternative rules could also be applied.

It will be appreciated by those skilled in the art that changes could be made to the embodiment described above without departing from the broad inventive concept thereof. It is understood, therefore, that this invention is not limited to the particular physical embodiment desclosed, but is intended to cover modifications within the spirit and scope of the present invention as defined by the appended claims.

We claim:

1. A method for interactively timing an unofficiated game in a sport such that audio outputs are generated at appropriate times in said game comprising:

(a). storing audio files; and (b). providing a first timer to keep track of game time and a second timer (c). providing a remote control means for players of said game to start and stop said first and second timers by wireless communication; and (d). providing an electro-acoustics device; and (e). providing a processor which:

(1) starts and stops said first and second timers when said remote control means are activated; and, (2) associates a first plurality of audio files with specified times on said first timer and a second plurality of audio files with specified times on said second timer;

(3) selects said audio files at said specified times on said first and second timers;

(4) not selecting one of said audio files associated with one of said first and second timers if it conflicts with a time of another of said first and second timers; and (5) passes said selected files to said electro-acoustics device thereby generating audible sounds.

2. A system in which a plurality of players in a sports game, during play action, wirelessly controls game time and simultaneously generates prerecorded verbal audible announcements, comprising:

(a) a plurality of switches, at least one switch is on one of said players of each team in said sport game, each is actuated by said player for the purpose of starting and stopping game time and for causing related said audible announcements to be made;

(b) a plurality of transmitters, at least on transmitter is on one of said players of each team in said sports game that, upon actuation by said switch, emits a predetermined radio frequency signal;

(c) a receiver that receives said radio frequency signal from said transmitter and converts said radio frequency signal into an electrical signal indicating receipt of command from said players;

(d) a first timer that clocks game time and that can be stopped and resumed and a second timer for tracking specified duration events;

(e) means to operate said in first and second timers response to receipt of said electrical signal from any of said transmitter based on a type of said electrical signal an action occurring including stopping said first and said second timers, starting said second timer and allowing said first timer to run and starting said first and said second timers;

(f) a storage device containing predetermined audio files and that outputs a data stream for the purpose of making said audible announcements;

(g) means to operate said storage device upon receipt of said electrical signal from said receiver; and (h) an electro-acoustic device that, upon receipt of said data stream from said storage device, converts said data stream into audible acoustic sounds; and whereby verbal said audible announcements are broadcast for players and spectators to hear in response to remote signaling by said player.

3. The system of claim 2 additionally comprising:

(a) processor means to operate said storage device causing said storage device to generate an output selected from the group consisting of data and signal to said electro-acoustic device at predetermined times as clocked by said first timer;

whereby verbal audible announcements and other game sounds are broadcast at predetermined game times, for players and spectators to hear, in response to the occurrence of said predetermined game times indicated by said timer.

4. The system of claim 2 wherein said audio files are stored digitally.

5. The system of claim 2 additionally comprising a visual display that displays remaining time on said first timer.

* * * * *